US011274417B2

(12) United States Patent
Kondo et al.

(10) Patent No.: US 11,274,417 B2
(45) Date of Patent: Mar. 15, 2022

(54) HYDRAULIC DRIVE SYSTEM OF CONSTRUCTION MACHINE

(71) Applicant: KAWASAKI JUKOGYO KABUSHIKI KAISHA, Kobe (JP)

(72) Inventors: Akihiro Kondo, Kobe (JP); Yoji Yudate, Kobe (JP); Takehisa Kato, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 232 days.

(21) Appl. No.: 16/647,840

(22) PCT Filed: Sep. 11, 2018

(86) PCT No.: PCT/JP2018/033616
§ 371 (c)(1),
(2) Date: Mar. 16, 2020

(87) PCT Pub. No.: WO2019/054365
PCT Pub. Date: Mar. 21, 2019

(65) Prior Publication Data

US 2020/0277755 A1 Sep. 3, 2020

(30) Foreign Application Priority Data

Sep. 15, 2017 (JP) ..... JP2017-177343

(51) Int. Cl.
*E02F 9/22* (2006.01)
*F15B 21/14* (2006.01)
(Continued)

(52) U.S. Cl.
CPC ..... *E02F 9/2217* (2013.01); *F15B 1/024* (2013.01); *F15B 21/14* (2013.01); *E02F 9/22* (2013.01);
(Continued)

(58) Field of Classification Search
CPC ..... F15B 21/14; F15B 2211/20546; F15B 2211/212; F15B 2211/88;
(Continued)

(56) References Cited

U.S. PATENT DOCUMENTS 7,124,576 B2 * 10/2006 Cherney ..... E02F 9/2217 60/414
7,269,944 B2 * 9/2007 Zhang ..... E02F 9/2217 60/414
(Continued)

FOREIGN PATENT DOCUMENTS

JP 2008-045365 A 2/2008

*Primary Examiner* — Dustin T Nguyen
(74) *Attorney, Agent, or Firm* — Oliff PLC

(57) ABSTRACT

A hydraulic drive system of a construction machine includes: a boom control valve connected to a boom cylinder by a boom raising supply line and a boom lowering supply line; a pump that sucks hydraulic oil through a suction line, and delivers the hydraulic oil through a delivery line; a regenerative valve that brings the boom raising supply line and the suction line into communication with each other through a regenerative line when a boom lowering operation is performed; and a controller that controls an accumulator switching valve. The controller: switches the accumulator switching valve to a pressure accumulation position when a pressure accumulation condition is satisfied; switches the accumulator switching valve to a pressure release position when a pressure release condition is satisfied; and switches the accumulator switching valve to a neutral position when neither the pressure accumulation condition nor the pressure release condition is satisfied.

13 Claims, 5 Drawing Sheets

(51) Int. Cl.
*F15B 1/02* (2006.01)
*F15B 1/033* (2006.01)

(52) U.S. Cl.
CPC ..... *E02F 9/2285* (2013.01); *E02F 9/2296* (2013.01); *F15B 1/033* (2013.01); *F15B 2211/20546* (2013.01); *F15B 2211/20576* (2013.01); *F15B 2211/212* (2013.01); *F15B 2211/30505* (2013.01); *F15B 2211/41572* (2013.01); *F15B 2211/55* (2013.01); *F15B 2211/6313* (2013.01); *F15B 2211/6346* (2013.01); *F15B 2211/7135* (2013.01); *F15B 2211/761* (2013.01); *F15B 2211/88* (2013.01)

(58) Field of Classification Search
CPC .... F15B 2211/20576; F15B 2211/7053; F15B 2211/7058; F15B 2211/761; F15B 2211/7135; F15B 2211/6309; F15B 2211/3058; F15B 1/024; F15B 1/033; E02F 9/2217; E02F 9/2296; E02F 9/2292; E02F 9/123; E02F 9/2267; E02F 9/2235; E02F 9/22
See application file for complete search history.

(56) References Cited

U.S. PATENT DOCUMENTS

| | | | | |
|---|---|---|---|---|
| 9,932,722 | B2 * | 4/2018 | Wu | E02F 9/2217 |
| 10,006,473 | B2 * | 6/2018 | Nishikawa | E02F 9/2282 |
| 10,100,847 | B2 * | 10/2018 | Wu | E02F 9/2296 |
| 11,035,100 | B2 * | 6/2021 | Kondo | F15B 21/14 |
| 2008/0110166 | A1 * | 5/2008 | Stephenson | E02F 9/2296 60/414 |
| 2018/0291935 | A1 * | 10/2018 | Kondo | F15B 11/10 |
| 2020/0407946 | A1 * | 12/2020 | Kondo | F15B 11/02 |

* cited by examiner

HYDRAULIC DRIVE SYSTEM OF CONSTRUCTION MACHINE

TECHNICAL FIELD

The present invention relates to a hydraulic drive system of a construction machine.

BACKGROUND ART

In construction machines such as a hydraulic excavator and a hydraulic crane, a hydraulic drive system including a boom cylinder that drives a boom is installed. In such a hydraulic drive system, when a boom lowering operation is performed, the potential energy of the boom can be accumulated in an accumulator as pressure. The energy accumulated in the accumulator is utilized, for example, when a boom raising operation is performed.

For example, Patent Literature 1 discloses a hydraulic drive system of a construction machine, in which a boom cylinder and a boom control valve are connected to each other by a boom raising supply line and a boom lowering supply line, and a regenerative line extends from the boom raising supply line to an accumulator. The boom control valve blocks the boom raising supply line when a boom lowering operation is performed. As a result, hydraulic oil discharged from the boom cylinder flows into the accumulator through the regenerative line.

CITATION LIST

Patent Literature

PTL 1: Japanese Laid-Open Patent Application Publication No. 2008-45365

SUMMARY OF INVENTION

Technical Problem

In the hydraulic drive system disclosed by Patent Literature 1, the regenerative line is provided with an open/close valve. The boom lowering speed is controlled depending on the opening area of the open/close valve. However, the pressure of the accumulator is not constant, but increases in accordance with increase in the amount of hydraulic oil injected into the accumulator. Therefore, when the open/close valve provided on the regenerative line is controlled, the boom lowering speed will not be as intended by an operator due to the pressure of the accumulator.

It should be noted that the accumulation of energy in the accumulator can be performed not only when a boom lowering operation is performed, but also when a turning deceleration operation is performed, which is an operation of decreasing the turning speed of a turning unit that is turned by a turning motor. However, the aforementioned problem, i.e., the speed will not be as intended by the operator due to the pressure of the accumulator, applies also in this case.

In view of the above, an object of the present invention is to provide a hydraulic drive system of a construction machine, the hydraulic drive system making it possible to prevent changes in the pressure of the accumulator from affecting a boom lowering speed or a turning speed when a boom lowering operation or a turning deceleration operation is performed.

Solution to Problem

In order to solve the above-described problems, a hydraulic drive system of a construction machine according to one aspect of the present invention includes: a boom cylinder; a boom control valve connected to the boom cylinder by a boom raising supply line and a boom lowering supply line, the boom control valve blocking the boom raising supply line when a boom lowering operation is performed; a pump that sucks hydraulic oil through a suction line provided with a check valve, and delivers the hydraulic oil through a delivery line; a regenerative line that connects between the boom raising supply line and a portion of the suction line downstream of the check valve; a regenerative valve that brings the boom raising supply line and the portion of the suction line downstream of the check valve into communication with each other through the regenerative line when the boom lowering operation is performed, and prohibits the hydraulic oil from flowing through the regenerative line when the boom lowering operation is not performed; a relief valve that keeps a pressure of the portion of the suction line downstream of the check valve to a predetermined pressure or lower; an accumulator switching valve that is switched between a pressure accumulation position, in which the accumulator switching valve connects an accumulator to the delivery line, a pressure release position, in which the accumulator switching valve connects the accumulator to the portion of the suction line downstream of the check valve, and a neutral position, in which the accumulator switching valve shuts off the accumulator from the delivery line and the portion of the suction line downstream of the check valve; and a controller that controls the accumulator switching valve. The controller: switches the accumulator switching valve to the pressure accumulation position when a pressure accumulation condition is satisfied, the pressure accumulation condition being defined to include that the boom lowering operation is performed alone; switches the accumulator switching valve to the pressure release position when a pressure release condition is satisfied; and switches the accumulator switching valve to the neutral position when neither the pressure accumulation condition nor the pressure release condition is satisfied.

According to the above configuration, when the boom lowering operation is performed, high-pressure hydraulic oil discharged from the boom cylinder is led to the suction line through the regenerative line. In a case where the accumulator switching valve is in the neutral position and the boom lowering operation is performed concurrently with another operation in which the pump supplies the hydraulic oil to a hydraulic actuator different from the boom cylinder, motive power and a workload to be borne by the pump can be reduced, because the high-pressure hydraulic oil is supplied to the suction side of the pump.

On the other hand, when the boom lowering operation is performed alone, since the accumulator switching valve is switched to the pressure accumulation position, the potential energy of the boom can be accumulated in the accumulator as pressure. At the time, since the pump is interposed between the regenerative valve and the accumulator, and also, the pressure downstream of the regenerative valve is kept to a constant pressure by the relief valve, the boom lowering speed mainly depends on the opening area of the regenerative valve. This makes it possible to prevent changes in the pressure of the accumulator from affecting the boom lowering speed.

The pressure accumulation condition may be defined to include that the boom lowering operation is performed alone, and that the boom lowering operation is performed concurrently with another operation and a delivery pressure of the pump at the time is lower than a threshold. According to this configuration, not only when the boom lowering operation is performed alone, but also when the boom lowering operation is performed concurrently with another particular operation, the potential energy of the boom can be accumulated in the accumulator.

The pressure release condition may be that a delivery pressure of the pump is higher than a reference value. According to this configuration, the energy accumulated in the accumulator can be utilized when the load on the hydraulic actuator to which the hydraulic oil is supplied from the pump is relatively great.

The pump, the suction line, and the delivery line may be a first pump, a first suction line, and a first delivery line, respectively. The above hydraulic drive system may further include: an arm cylinder; an arm control valve connected to the arm cylinder by an arm crowding supply line and an arm pushing supply line; and a second pump that sucks the hydraulic oil through a second suction line, and delivers the hydraulic oil through a second delivery line. The first pump may be connected to the arm control valve by the first delivery line, and the second pump may be connected to the boom control valve by the second delivery line. According to this configuration, when the boom lowering operation is performed, energy can be accumulated in the accumulator by using the first pump while supplying the hydraulic oil to the boom cylinder by using the second pump.

The regenerative line may be provided with a check valve that allows the hydraulic oil to flow from the boom raising supply line to the first suction line, and prohibits the hydraulic oil from flowing from the first suction line to the boom raising supply line. The second suction line may be provided with a check valve, and a portion of the second suction line downstream of the check valve may be connected by a relay line to a portion, of the regenerative line, that is closer to the boom raising supply line than the check valve of the regenerative line is. The relay line may be provided with a check valve that allows the hydraulic oil to flow from the regenerative line to the second suction line, and prohibits the hydraulic oil from flowing from the second suction line to the regenerative line. The above hydraulic drive system may further include a relief valve that keeps a pressure of the portion of the second suction line downstream of the check valve to a predetermined pressure or lower. According to this configuration, when the boom lowering operation is performed, the high-pressure hydraulic oil discharged from the boom cylinder is supplied also to the suction side of the second pump, and thereby motive power and a workload to be borne by the second pump can be reduced.

The first pump may be a variable displacement pump whose minimum delivery flow rate is set to be greater than zero. The above hydraulic drive system may further include an unloading valve provided on an unloading line that is branched off from the first delivery line. The controller may fully close the unloading valve when the boom lowering operation is performed alone. According to this configuration, when the boom lowering operation is performed alone, bleed-off through the unloading line is interrupted, and thereby energy can be accumulated. In addition, the boom control valve is connected to the second pump, which is not provided with the accumulator. Therefore, when the boom lowering operation is performed alone, the potential energy of the boom can be accumulated in the accumulator to the utmost degree without sacrificing the boom lowering speed.

A hydraulic drive system of a construction machine according to another aspect of the present invention includes: a turning motor; a turning supply valve connected to the turning motor by a pair of turning supply lines, the turning supply valve blocking one of the turning supply lines when a turning operation is performed; a pump that sucks hydraulic oil through a suction line provided with a check valve, and delivers the hydraulic oil through a delivery line; a regenerative motor coupled to the pump; a first turning discharge valve that allows the hydraulic oil to flow from one of the turning supply lines to a tank when a turning acceleration operation is performed and when a turning constant speed operation is performed, and prohibits the hydraulic oil from flowing from one and both of the turning supply lines to the tank when neither the turning acceleration operation nor the turning constant speed operation is performed; a second turning discharge valve that allows the hydraulic oil to flow from one of the turning supply lines to the regenerative motor when a turning deceleration operation is performed, and prohibits the hydraulic oil from flowing from both of the turning supply lines to the regenerative motor when the turning deceleration operation is not performed; an accumulator switching valve that is switched between a pressure accumulation position, in which the accumulator switching valve connects an accumulator to the delivery line, a pressure release position, in which the accumulator switching valve connects the accumulator to a portion of the suction line downstream of the check valve, and a neutral position, in which the accumulator switching valve shuts off the accumulator from the delivery line and the portion of the suction line downstream of the check valve; and a controller that controls the accumulator switching valve. The controller: switches the accumulator switching valve to the pressure accumulation position when a pressure accumulation condition is satisfied, the pressure accumulation condition being defined to include that the turning deceleration operation is performed alone; switches the accumulator switching valve to the pressure release position when a pressure release condition is satisfied; and switches the accumulator switching valve to the neutral position when neither the pressure accumulation condition nor the pressure release condition is satisfied.

According to the above configuration, when the turning deceleration operation is performed, high-pressure hydraulic oil discharged from the turning motor is led to the regenerative motor. Accordingly, motive power and energy are regenerated from the hydraulic oil discharged from the turning motor, and the regenerated motive power and energy assist the driving of the pump. Therefore, in a case where the accumulator switching valve is in the neutral position and the turning deceleration operation is performed concurrently with another operation, the regenerated motive power and energy are directly utilized for moving a hydraulic actuator different from the turning motor.

On the other hand, when the turning deceleration operation is performed alone, since the accumulator switching valve is switched to the pressure accumulation position, the regenerated motive power and energy can be accumulated in the accumulator as pressure. At the time, since the regenerative motor and the pump are interposed between the second turning discharge valve and the accumulator, the turning speed mainly depends on the opening area of the second turning discharge valve. This makes it possible to prevent changes in the pressure of the accumulator from affecting the turning speed.

The regenerative motor may be coupled to the pump via a one-way clutch that allows transmission of rotation and torque from the regenerative motor to the pump only when a rotational speed of the regenerative motor is higher than a rotational speed of the pump. According to this configuration, when the turning deceleration operation is not performed, the regenerative motor can be prevented from rotating together with the pump, and thereby wasteful motive power consumption can be prevented.

For example, the pump may be connected to the turning supply valve by the delivery line.

The pressure accumulation condition may be defined to include that the turning deceleration operation is performed alone, and that the turning deceleration operation is performed concurrently with another operation and a delivery pressure of the pump at the time is lower than a threshold. According to this configuration, not only when the turning deceleration operation is performed alone, but also when the turning deceleration operation is performed concurrently with another particular operation, the regenerated motive power and energy can be accumulated in the accumulator.

The pressure release condition may be that the turning deceleration operation is not performed and a delivery pressure of the pump at the time is higher than a reference value. According to this configuration, the regenerated motive power and energy accumulated in the accumulator can be utilized when the load on the hydraulic actuator to which the hydraulic oil is supplied from the pump is relatively great.

The pump may be a variable displacement pump whose minimum delivery flow rate is set to be greater than zero. The above hydraulic drive system may further include an unloading valve provided on an unloading line that is branched off from the delivery line. The controller may fully close the unloading valve when the turning deceleration operation is performed alone. According to this configuration, when the turning deceleration operation is performed alone, bleed-off through the unloading line is interrupted, and thereby the regenerated motive power and energy can be accumulated without waste.

For example, the regenerative motor may be a variable displacement motor.

Advantageous Effects of Invention

The present invention makes it possible to prevent changes in the pressure of the accumulator from affecting a boom lowering speed or a turning speed when a boom lowering operation or a turning deceleration operation is performed.

DESCRIPTION OF EMBODIMENTS

Embodiment 1

Figure 1:
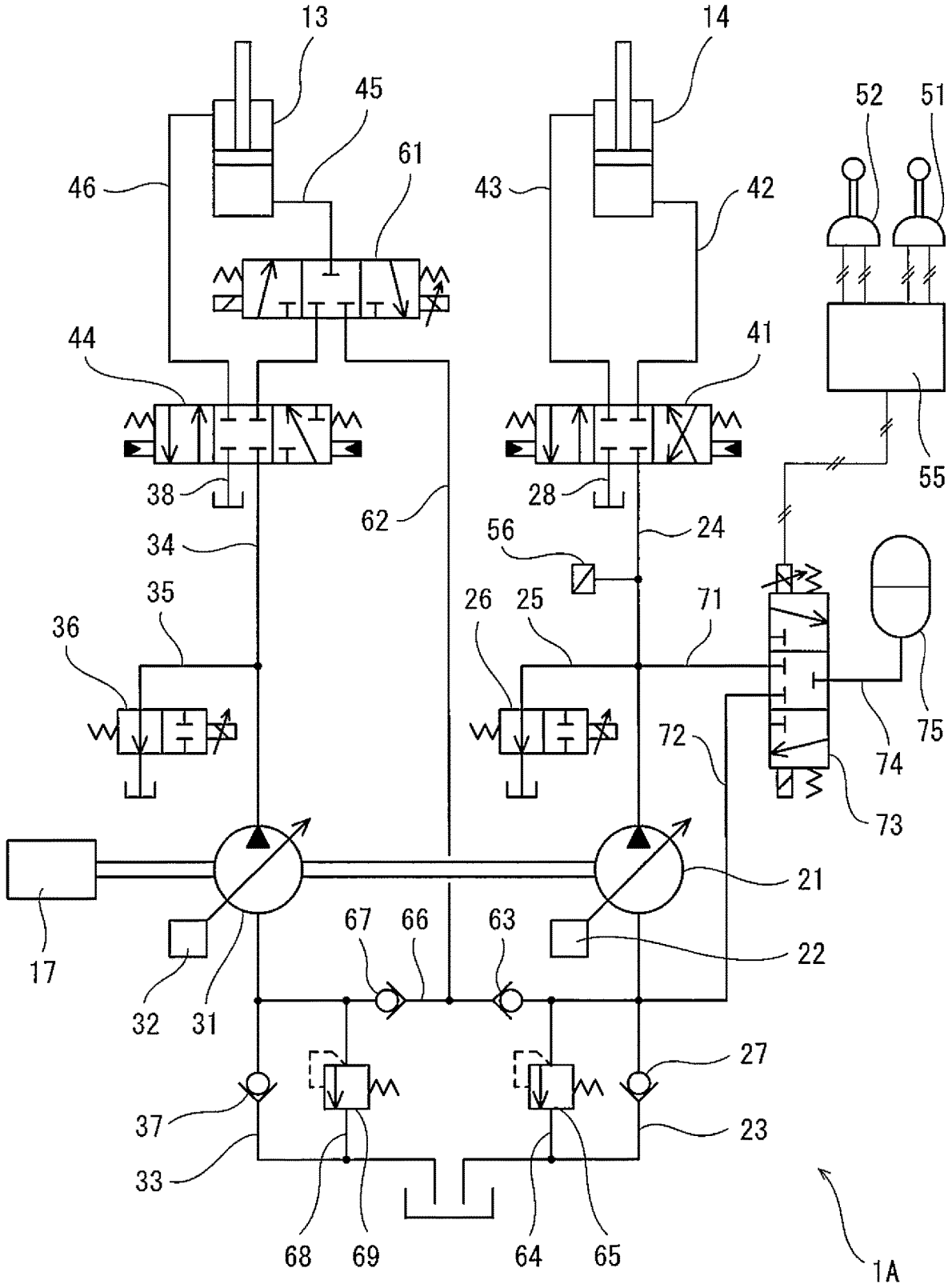
FIG. 1 shows a schematic configuration of a hydraulic drive system of a construction machine according to Embodiment 1 of the present invention.
Figure 2:
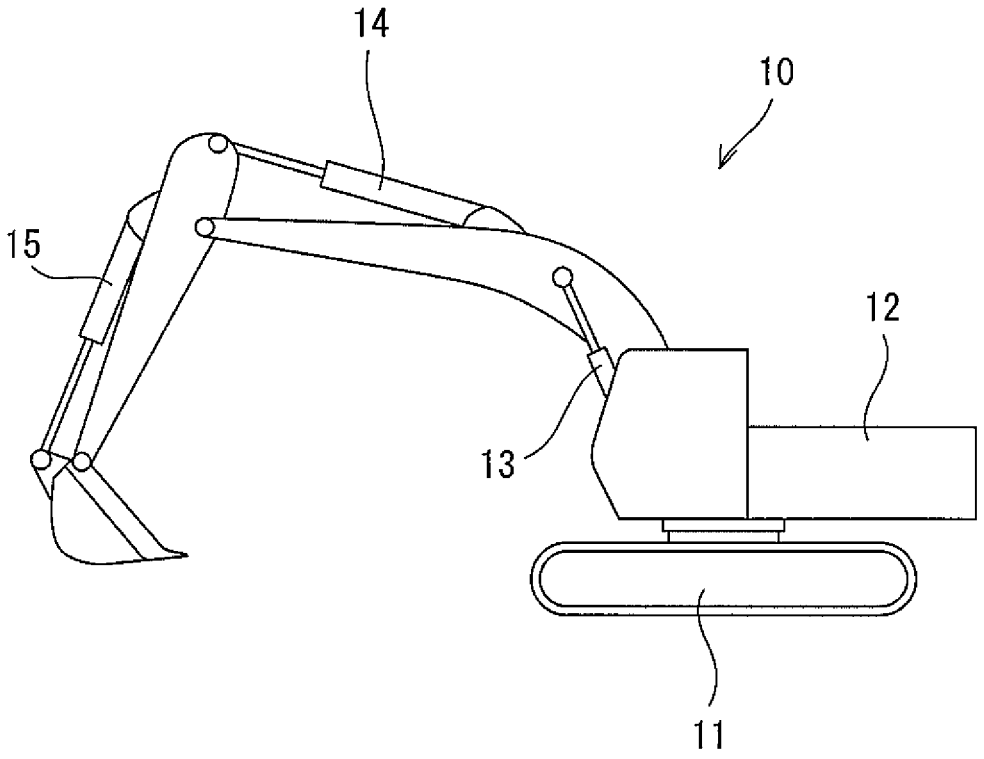
FIG. 2 is a side view of a hydraulic excavator that is one example of the construction machine.

FIG. 1 shows a hydraulic drive system 1A of a construction machine according to Embodiment 1 of the present invention. FIG. 2 shows a construction machine 10, in which the hydraulic drive system 1A is installed. Although the construction machine 10 shown in FIG. 2 is a hydraulic excavator, the present invention is also applicable to other construction machines, such as a hydraulic crane.

The construction machine 10 shown in FIG. 2 is of a self-propelled type, and includes: a running unit 11; and a turning unit 12 turnably supported by the running unit 11. The turning unit 12 is equipped with a cabin including an operator's seat. A boom is coupled to the turning unit 12. An arm is coupled to the distal end of the boom, and a bucket is coupled to the distal end of the arm. However, the construction machine 10 need not be of a self-propelled type.

The hydraulic drive system 1A includes, as hydraulic actuators, a boom cylinder 13, an arm cylinder 14, and a bucket cylinder 15, which are shown in FIG. 2, and a turning motor, a left running motor, and a right running motor, which are not shown. As shown in FIG. 1, the hydraulic drive system 1A further includes a first pump 21 and a second pump 31, which supply a hydraulic liquid to these hydraulic actuators. It should be noted that, in FIG. 1, the hydraulic actuators other than the boom cylinder 13 and the arm cylinder 14 are not shown for the purpose of simplifying the drawing.

The first pump 21 and the second pump 31 are coupled to an engine 17. That is, the first pump 21 and the second pump 31 are driven by the same engine 17.

Each of the first pump 21 and the second pump 31 is a variable displacement pump (swash plate pump or bent axis pump) whose tilting angle is changeable. The tilting angle of the first pump 21 is adjusted by a regulator 22. The tilting angle of the second pump 31 is adjusted by a regulator 32. It should be noted that the minimum delivery flow rate of each of the first pump 21 and the second pump 31 is set to be greater than zero.

Each of the regulators 22 and 32 moves in accordance with, for example, an electrical signal. For example, in a case where the pump (21 or 31) is a swash plate pump, the regulator (22 or 32) may electrically change the hydraulic pressure applied to a servo piston coupled to the swash plate of the pump, or may be an electric actuator coupled to the swash plate of the pump.

In the present embodiment, the first pump 21 supplies the hydraulic oil to the arm cylinder 14, the unshown turning motor, and the unshown right running motor. The second pump 31 supplies the hydraulic oil to the boom cylinder 13, the bucket cylinder 15, and the unshown left running motor. Alternatively, both the first pump 21 and the second pump 31 may supply the hydraulic oil to the boom cylinder 13. In this case, when boom lowering is performed, desirably, the hydraulic oil is supplied to the boom cylinder 13 only from the second pump 31. Similarly, both the first pump 21 and the second pump 31 may supply the hydraulic oil to the arm cylinder 14.

The first pump 21 is connected to a tank by a first suction line 23, and is connected to an arm control valve 41, an unshown turning control valve, and an unshown right running control valve by a first delivery line 24. That is, the first pump 21 sucks the hydraulic oil through the first suction line 23, and delivers the hydraulic oil through the first delivery line 24.

The delivery pressure of the first pump 21 is kept to a relief pressure or lower by an unshown relief valve. An unloading line 25 is branched off from the first delivery line 24, and the unloading line 25 is provided with an unloading valve 26.

The second pump 31 is connected to the tank by a second suction line 33, and is connected to a boom control valve 44, an unshown bucket control valve, and the unshown right running control valve by a second delivery line 34. That is, the second pump 31 sucks the hydraulic oil through the second suction line 33, and delivers the hydraulic oil through the second delivery line 34.

The delivery pressure of the second pump 31 is kept to a relief pressure or lower by an unshown relief valve. An unloading line 35 is branched off from the second delivery line 34, and the unloading line 35 is provided with an unloading valve 36.

The aforementioned arm control valve 41 is connected to the arm cylinder 14 by an arm crowding supply line 42 and an arm pushing supply line 43. The arm control valve 41 is connected to the tank by a tank line 28.

As a result of an arm crowding operation or an arm pushing operation being performed with an arm operation device 51, the arm control valve 41 is switched from a neutral position, in which the arm control valve 41 blocks all the lines 24, 42, 43, and 28, to an arm crowding movement position (left-side position in FIG. 1) or an arm pushing movement position (right-side position in FIG. 1). When the arm control valve 41 is in the arm crowding movement position, the arm control valve 41 brings the arm crowding supply line 42 into communication with the first delivery line 24, and brings the arm pushing supply line 43 into communication with the tank line 28. On the other hand, when the arm control valve 41 is in the arm pushing movement position, the arm control valve 41 brings the arm pushing supply line 43 into communication with the first delivery line 24, and brings the arm crowding supply line 42 into communication with the tank line 28.

In the present embodiment, the arm control valve 41 is a hydraulic pilot-type valve, and includes a pair of pilot ports. Alternatively, the arm control valve 41 may be a solenoid pilot-type valve.

The arm operation device 51 includes an operating lever, and outputs an arm operation signal (arm crowding operation signal or arm pushing operation signal) corresponding to the inclination angle of the operating lever. Specifically, the arm operation signal outputted from the arm operation device 51 increases in accordance with increase in the inclination angle (i.e., operating amount) of the operating lever.

In the present embodiment, the arm operation device 51 is an electrical joystick that outputs an electrical signal as the arm operation signal. The arm operation signal outputted from the arm operation device 51 is inputted to a controller 55. For example, the controller 55 is a computer including a CPU and memories such as a ROM and RAM. The CPU executes a program stored in the ROM.

The controller 55 controls the arm control valve 41 via an unshown pair of solenoid proportional valves, such that the opening area of the arm control valve 41 is adjusted to an opening area corresponding to the arm operation signal. Alternatively, the arm operation device 51 may be a pilot operation valve that outputs a pilot pressure as the arm operation signal. In this case, the pilot ports of the arm control valve 41 are connected, by pilot lines, to the arm operation device 51, which is a pilot operation valve. In the case where the arm operation device 51 is a pilot operation valve, the pilot pressure outputted from the arm operation device 51 is detected by a pressure sensor, and inputted to the controller 55.

The controller 55 also controls the above-described regulator 22 and unloading valve 26. However, FIG. 1 shows only part of signal lines for simplifying the drawing. Normally, the controller 55 controls the regulator 22 and the unloading valve 26, such that the delivery flow rate of the first pump 21 increases and the opening area of the unloading valve 26 decreases in accordance with increase in the arm operation signal.

The above-described boom control valve 44 is connected to the boom cylinder 13 by a boom raising supply line 45 and a boom lowering supply line 46. The boom control valve 44 is connected to the tank by a tank line 38.

As a result of a boom raising operation or a boom lowering operation being performed with a boom operation device 52, the boom control valve 44 is switched from a neutral position, in which the boom control valve 44 blocks all the lines 34, 45, 46, and 38, to a boom raising movement position (left-side position in FIG. 1) or a boom lowering movement position (right-side position in FIG. 1). When the boom control valve 44 is in the boom raising movement position, the boom control valve 44 brings the boom raising supply line 45 into communication with the second delivery line 34, and brings the boom lowering supply line 46 into communication with the tank line (make-up line) 38. On the other hand, when the boom control valve 44 is in the boom lowering movement position, the boom control valve 44 brings the boom lowering supply line 46 into communication with the second delivery line 34, and blocks the boom raising supply line 45.

In the present embodiment, the boom control valve 44 is a hydraulic pilot-type valve, and includes a pair of pilot ports. Alternatively, the boom control valve 44 may be a solenoid pilot-type valve.

The boom operation device 52 includes an operating lever, and outputs a boom operation signal (boom raising operation signal or boom lowering operation signal) corresponding to the inclination angle of the operating lever. Specifically, the boom operation signal outputted from the boom operation device 52 increases in accordance with increase in the inclination angle (i.e., operating amount) of the operating lever.

In the present embodiment, the boom operation device 52 is an electrical joystick that outputs an electrical signal as the boom operation signal. The boom operation signal outputted from the boom operation device 52 is inputted to the controller 55.

The controller 55 controls the boom control valve 44 via an unshown pair of solenoid proportional valves, such that the opening area of the boom control valve 44 is adjusted to an opening area corresponding to the boom operation signal. Alternatively, the boom operation device 52 may be a pilot operation valve that outputs a pilot pressure as the boom operation signal. In this case, the pilot ports of the boom control valve 44 are connected, by pilot lines, to the boom operation device 52, which is a pilot operation valve. In the case where the boom operation device 52 is a pilot operation valve, the pilot pressure outputted from the boom operation device 52 is detected by a pressure sensor, and inputted to the controller 55.

The controller 55 also controls the above-described regulator 32 and unloading valve 36. Normally, the controller 55 controls the regulator 32 and the unloading valve 36, such that the delivery flow rate of the second pump 31 increases and the opening area of the unloading valve 36 decreases in accordance with increase in the boom operation signal.

The present embodiment further adopts a configuration for accumulating the potential energy of the boom by utilizing the first pump 21.

Specifically, the first suction line 23 is provided with a check valve 27. A portion of the first suction line 23 downstream of the check valve 27 is connected to the boom raising supply line 45 by a regenerative line 62.

In the present embodiment, a regenerative valve 61 is provided at a position where the regenerative line 62 connects to the boom raising supply line 45. That is, the regenerative valve 61 is incorporated in the boom raising supply line 45 in such a manner that the regenerative valve 61 divides the boom raising supply line 45 into a first passage on the boom cylinder 13 side and a second passage on the boom control valve 44 side.

The regenerative line 62 is provided with a check valve 63 at a position between the regenerative valve 61 and the first suction line 23. The check valve 63 allows the hydraulic oil to flow from the boom raising supply line 45 to the first suction line 23, and prohibits the hydraulic oil from flowing from the first suction line 23 to the boom raising supply line 45.

The regenerative valve 61 is controlled by the controller 55. When a boom raising operation is performed (i.e., when the boom raising operation signal is outputted from the boom operation device 52), the controller 55 switches the regenerative valve 61 from a neutral position, in which the regenerative valve 61 blocks the first and second passages of the boom raising supply line 45 and the regenerative line 62, to a first position (left-side position in FIG. 1), in which the regenerative valve 61 brings the first passage of the boom raising supply line 45 into communication with the second passage. On the other hand, when a boom lowering operation is performed (i.e., when the boom lowering operation signal is outputted from the boom operation device 52), the controller 55 switches the regenerative valve 61 from the neutral position to a second position (right-side position in FIG. 1), in which the regenerative valve 61 brings the first passage of the boom raising supply line 45 into communication with the regenerative line 62. It should be noted that, when the boom lowering operation is performed, the controller 55 adjusts the opening area of the regenerative valve 61 in accordance with the boom lowering operation signal.

That is, when the boom lowering operation is performed, the regenerative valve 61 brings the boom raising supply line 45 and the portion of the first suction line 23 downstream of the check valve 27 into communication with each other through the regenerative line 62 to allow a flow from the regenerative line 62 toward the first suction line 23 (here, the check valve 63 prohibits a flow from the first suction line 23 toward the regenerative line 62). When the boom lowering operation is not performed, the regenerative valve 61 prohibits the hydraulic oil from flowing through the regenerative line 62. It should be noted that the regenerative valve 61 is not limited to a three-position valve shown in FIG. 1, but may be a two-position valve without the neutral position. Further alternatively, the regenerative valve 61 may be constituted by: a three-position or two-position direction switching valve provided at a position where the regenerative line 62 connects to the boom raising supply line 45; and a variable restrictor provided on the regenerative line 62.

The portion of the first suction line 23 downstream of the check valve 27 is connected to the tank by a relief line 64, and the relief line 64 is provided with a relief valve 65. Although in the illustrated example the relief line 64 is branched off from the regenerative line 62, the relief line 64 may be, of course, branched off from the first suction line 23 or from a pressure release line 72, which will be described below. The relief pressure of the relief valve 65 is set to a predetermined pressure Ps (e.g., 0.5 to 8 MPa). Accordingly, the pressure of the portion of the first suction line 23 downstream of the check valve 27 and the pressure of the regenerative line 62 are kept to the predetermined pressure Ps or lower by the relief valve 65. That is, the pressure of the portion of the first suction line 23 downstream of the check valve 27 can be prevented, by the relief valve 65, from becoming excessively high.

The portion of the first suction line 23 downstream of the check valve 27 is also connected to an accumulator switching valve 73 by the pressure release line 72. The accumulator switching valve 73 is connected to the first delivery line 24 by a pressure accumulation line 71, and connected to an accumulator 75 by a relay line 74.

The accumulator switching valve 73 is switched between a neutral position, a pressure accumulation position (upper position in FIG. 1), and a pressure release position (lower position in FIG. 1). When the accumulator switching valve 73 is in the neutral position, the accumulator switching valve 73 blocks the pressure accumulation line 71, the pressure release line 72, and the relay line 74, and shuts off the accumulator 75 from the first delivery line 24 and the portion of the first suction line 23 downstream of the check valve 27. When the accumulator switching valve 73 is in the pressure accumulation position, the accumulator switching valve 73 brings the pressure accumulation line 71 into communication with the relay line 74 to connect the accumulator 75 to the first delivery line 24. When the accumulator switching valve 73 is in the pressure release position, the accumulator switching valve 73 brings the relay line 74 into communication with the pressure release line 72 to connect the accumulator 75 to the portion of the first suction line 23 downstream of the check valve 27.

The accumulator switching valve 73 is controlled by the controller 55. The controller 55 determines whether or not a pressure accumulation condition is satisfied, and determines whether or not a pressure release condition is satisfied. When the pressure accumulation condition is satisfied, the controller 55 switches the accumulator switching valve 73 to the pressure accumulation position. When the pressure release condition is satisfied, the controller 55 switches the accumulator switching valve 73 to the pressure release position. When neither the pressure accumulation condition nor the pressure release condition is satisfied, the controller 55 switches the accumulator switching valve 73 to the neutral position.

The controller 55 is electrically connected to a pressure sensor 56 provided on the first delivery line 24. The pressure sensor 56 detects the delivery pressure of the first pump 21. In the present embodiment, the pressure accumulation condition is defined to include that a boom lowering operation is performed alone, and that a boom lowering operation is performed concurrently with another operation and the delivery pressure of the first pump 21 detected by the pressure sensor 56 at the time is lower than a threshold $\alpha 1$.

It should be noted that since operation signals outputted from an unshown turning operation device, an unshown bucket operation device, an unshown left-running operation device, and an unshown right-running operation device are also inputted to the controller 55, the controller 55 can determine whether or not the pressure accumulation condition is satisfied based on all the operation signals inputted to the controller 55.

When the boom lowering operation is performed alone, the controller 55 fully closes the unloading valve 26, and maximizes the opening area of the accumulator switching valve 73.

When the pressure accumulation condition is satisfied, if the satisfied pressure accumulation condition is that the boom lowering operation is performed concurrently with another operation and the delivery pressure of the first pump 21 at the time is lower than the threshold α1, the controller 55 controls the unloading valve 26, such that the opening area of the unloading valve 26 is adjusted to an opening area corresponding to the operation signal of the other operation. In addition, the controller 55 adjusts the opening area of the accumulator switching valve 73 in accordance with a pressure difference between the delivery pressure of the first pump 21 and the setting pressure of the accumulator 75.

The pressure release condition is that the delivery pressure of the first pump 21 detected by the pressure sensor 56 is higher than a reference value α2. The reference value α2 associated with the pressure release condition is greater than the threshold α1 associated with the pressure accumulation condition. However, the pressure release condition is not limited to such a condition, but may be a condition that a particular operation is performed.

The present embodiment further adopts a configuration for utilizing the potential energy of the boom to drive the second pump 31.

Specifically, the second suction line 33 is provided with a check valve 37. A portion of the second suction line 33 downstream of the check valve 37 is connected by a relay line 66 to a portion, of the regenerative line 62, that is closer to the boom raising supply line 45 than the check valve 63 is.

The relay line 66 is provided with a check valve 67, which allows the hydraulic oil to flow from the regenerative line 62 to the second suction line 33, and prohibits the hydraulic oil from flowing from the second suction line 33 to the regenerative line 62.

Accordingly, when the aforementioned regenerative valve 61 is in the second position (i.e., when a boom lowering operation is performed), the regenerative valve 61 brings the boom raising supply line 45 and the portion of the second suction line 33 downstream of the check valve 37 into communication with each other through the regenerative line 62 to allow a flow from the regenerative line 62 toward the second suction line 33 (here, the check valve 67 prohibits a flow from the second suction line 33 toward the regenerative line 62).

The portion of the second suction line 33 downstream of the check valve 37 is connected to the tank by a relief line 68, and the relief line 68 is provided with a relief valve 69. Although in the illustrated example the relief line 68 is branched off from the relay line 66, the relief line 68 may be, of course, branched off from the second suction line 33. The relief pressure of the relief valve 69 is set to the aforementioned predetermined pressure Ps. Accordingly, the pressure of the portion of the second suction line 33 downstream of the check valve 37 is kept to the predetermined pressure Ps or lower by the relief valve 69.

When a boom lowering operation is performed, it is desirable that the pressure of the regenerative line 62 be kept to the aforementioned predetermined pressure Ps. In order to realize this, the controller 55 controls the regulator 22 of the first pump 21, such that the sum Qt (=Q1+Q2) of the delivery flow rate Q1 of the first pump 21 and the delivery flow rate Q2 of the second pump 31 is less than the flow rate Qm of the hydraulic oil discharged from the boom cylinder 13 (Qt<Qm).

As described above, in the hydraulic drive system 1A of the present embodiment, when a boom lowering operation is performed, high-pressure hydraulic oil discharged from the boom cylinder 13 is led to the first suction line 23 and the second suction line 33 through the regenerative line 62. In a case where the accumulator switching valve 73 is in the neutral position and the boom lowering operation is performed concurrently with another operation (e.g., an arm operation) in which the first pump 21 supplies the hydraulic oil to a hydraulic actuator different from the boom cylinder 13, motive power and a workload to be borne by the first pump 21 can be reduced, because the high-pressure hydraulic oil is supplied to the suction side of the first pump 21.

On the other hand, when the boom lowering operation is performed alone, since the accumulator switching valve 73 is switched to the pressure accumulation position, the potential energy of the boom can be accumulated in the accumulator 75 as pressure. At the time, since the first pump 21 is interposed between the regenerative valve 61 and the accumulator 75, and also, the pressure downstream of the regenerative valve 61 is kept to the constant pressure Ps by the relief valves 65 and 69, the boom lowering speed mainly depends on the opening area of the regenerative valve 61. This makes it possible to prevent changes in the pressure of the accumulator 75 from affecting the boom lowering speed.

It should be noted that the pressure accumulation condition may only be that a boom lowering operation is performed alone. However, if the pressure accumulation condition is set as in the present embodiment, not only when the boom lowering operation is performed alone, but also when the boom lowering operation is performed concurrently with another particular operation, the potential energy of the boom can be accumulated in the accumulator 75.

Further, in the present embodiment, the pressure release condition is that the delivery pressure of the first pump 21 is higher than the reference value α2. Therefore, the energy accumulated in the accumulator 75 can be utilized when the load on the hydraulic actuator to which the hydraulic oil is supplied from the first pump 21 is relatively great.

Still further, in the present embodiment, when the boom lowering operation is performed alone, the unloading valve 26 is fully closed. Accordingly, when the boom lowering operation is performed alone, bleed-off through the unloading line 25 is interrupted, and thereby energy can be accumulated. In addition, the boom control valve 44 is connected to the second pump 31, which is not provided with the accumulator 75. Therefore, when the boom lowering operation is performed alone, the potential energy of the boom can be accumulated in the accumulator 75 to the utmost degree without sacrificing the boom lowering speed.

Still further, since the present embodiment is provided with the relay line 66, when the boom lowering operation is performed, the high-pressure hydraulic oil discharged from the boom cylinder 13 is supplied also to the suction side of the second pump, and thereby motive power and a workload to be borne by the second pump can be reduced.

Embodiment 2

Figure 3:
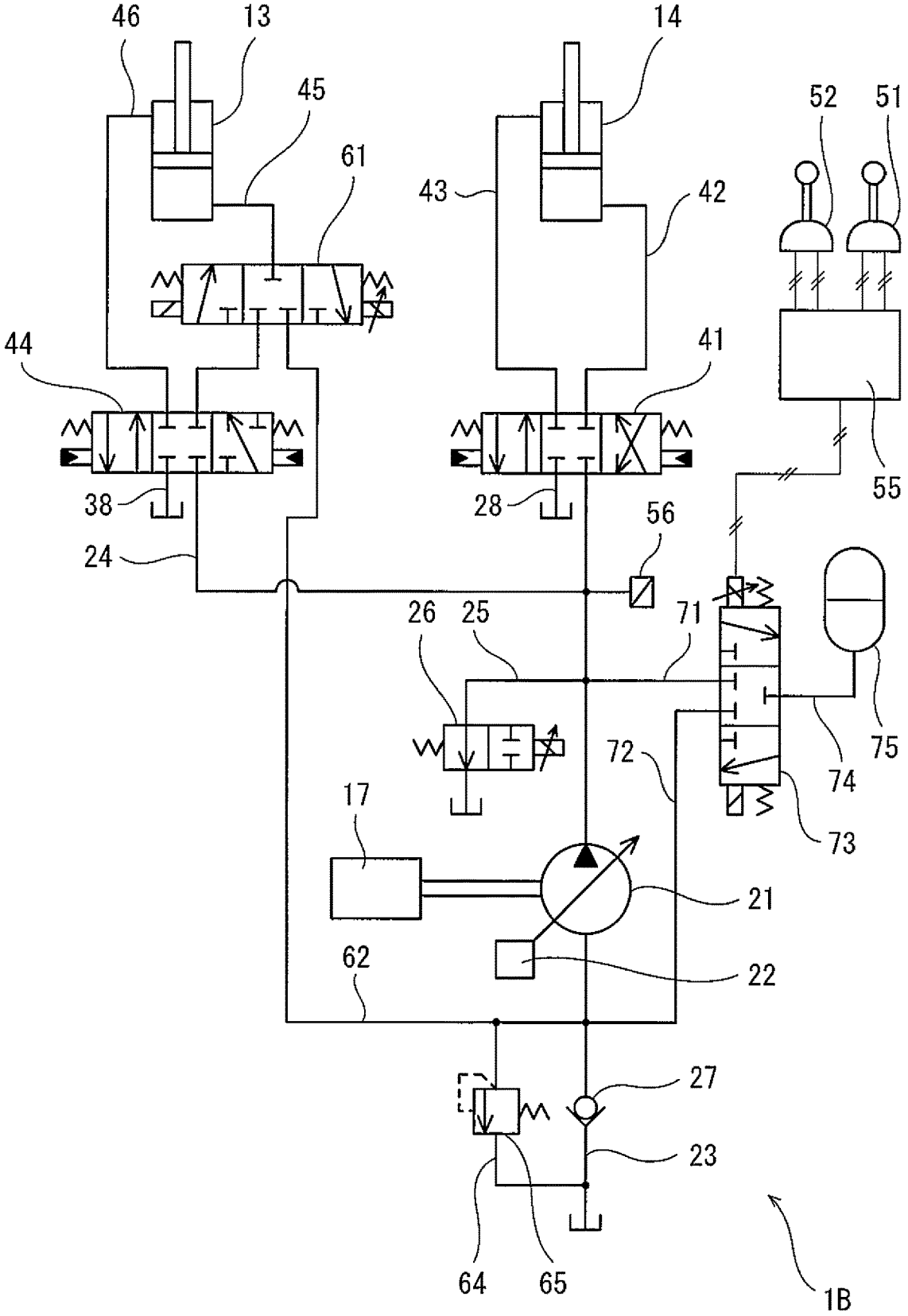
FIG. 3 shows a schematic configuration of a hydraulic drive system of a construction machine according to Embodiment 2 of the present invention.

FIG. 3 shows a hydraulic drive system 1B of a construction machine according to Embodiment 2 of the present invention. It should be noted that, in the present embodiment and the following Embodiment 3, the same components as those described in Embodiment 1 are denoted by the same reference signs as those used in Embodiment 1, and repeating the same descriptions is avoided.

In the present embodiment, the second pump 31 (see FIG. 1) is eliminated, and the first pump 21 is connected to all the control valves by the first delivery line 24. The present embodiment provides the same advantageous effects as those provided by Embodiment 1. However, if both the first pump 21 and the second pump 31 are used as in Embodiment 1, when a boom lowering operation is performed, energy can be accumulated in the accumulator 75 by using the first pump 21 while supplying the hydraulic oil to the boom cylinder 13 by using the second pump 31.

Also in the present embodiment, when a boom lowering operation is performed, it is desirable that the pressure of the regenerative line 62 be kept to the predetermined pressure Ps, which is the relief pressure of the relief valve 65. In order to realize this, the controller 55 controls the regulator 22 of the first pump 21, such that the delivery flow rate Q1 of the first pump 21 is less than the flow rate Qm of the hydraulic oil discharged from the boom cylinder 13 (Q1<Qm).

Embodiment 3

Figure 4:
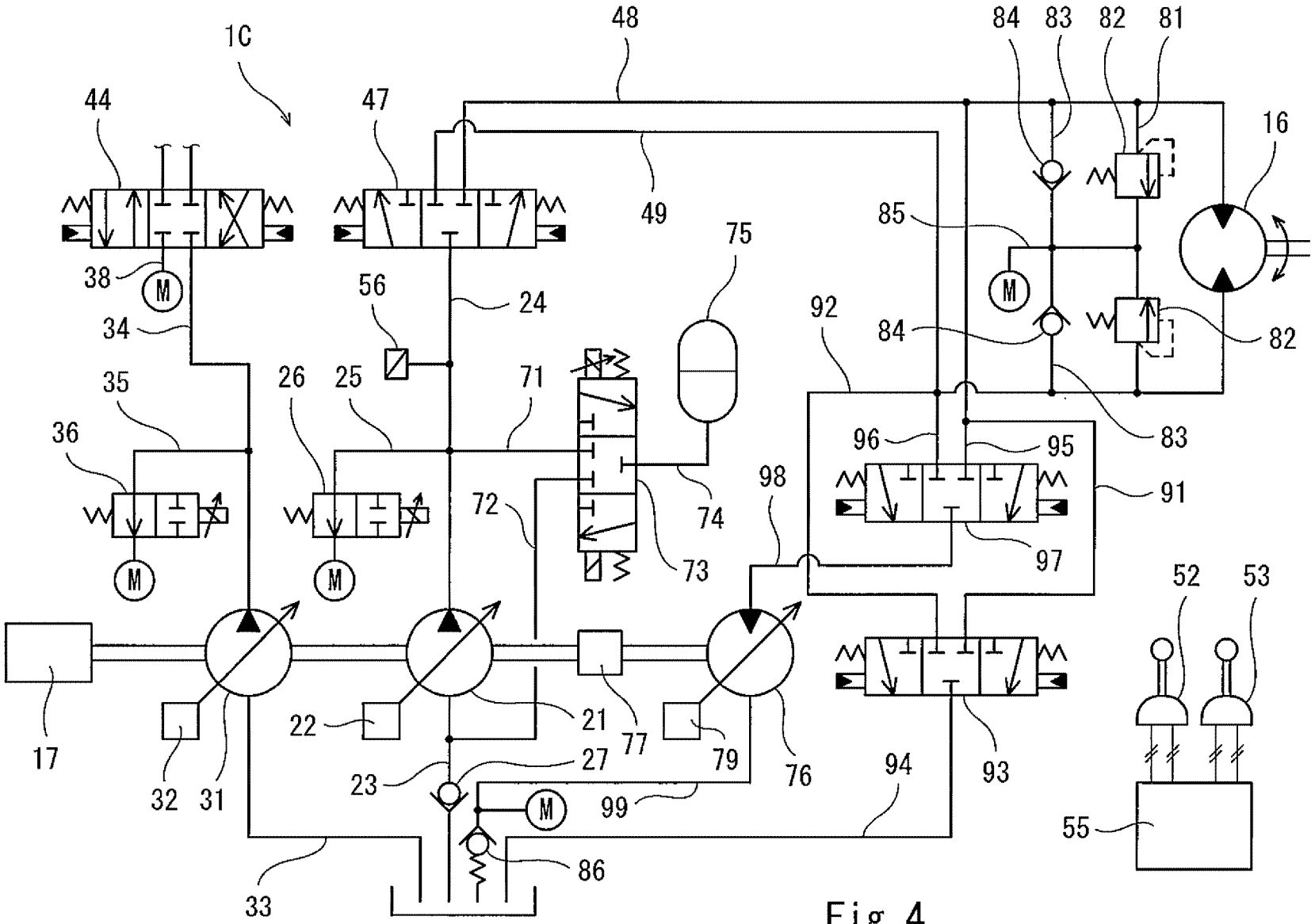
FIG. 4 shows a schematic configuration of a hydraulic drive system of a construction machine according to Embodiment 3 of the present invention.

FIG. 4 shows a hydraulic drive system 1C of a construction machine according to Embodiment 3 of the present invention. In the present embodiment, a regenerative motor 76, a turning supply valve 47, a first turning discharge valve 93, and a second turning discharge valve 97 are adopted instead of the regenerative valve 61 and the unshown turning control valve of Embodiment 1. Accordingly, the check valve 37 is not provided on the second suction line 33 of the second pump 31.

Specifically, the first pump 21 is connected to the turning supply valve 47, the unshown arm control valve, and the unshown right running control valve by the first delivery line 24. The turning supply valve 47 is connected to a turning motor 16 by a pair of turning supply lines (a left turning supply line 48 and a right turning supply line 49).

As a result of a left turning operation or a right turning operation being performed with a turning operation device 53, the turning supply valve 47 is switched from a neutral position, in which the turning supply valve 47 blocks all the lines 24, 48, and 49, to a left turning movement position (right-side position in FIG. 4) or a right turning movement position (left-side position in FIG. 4). When the turning supply valve 47 is in the left turning movement position, the turning supply valve 47 brings the left turning supply line 48 into communication with the first delivery line 24, and blocks the right turning supply line 49. On the other hand, when the turning supply valve 47 is in the right turning movement position, the turning supply valve 47 brings the right turning supply line 49 into communication with the first delivery line 24, and blocks the left turning supply line 48.

In the present embodiment, the turning supply valve 47 is a hydraulic pilot-type valve, and includes a pair of pilot ports. Alternatively, the turning supply valve 47 may be a solenoid pilot-type valve.

The turning operation device 53 includes an operating lever, and outputs a turning operation signal (left turning operation signal or right turning operation signal) corresponding to the inclination angle of the operating lever. Specifically, the turning operation signal outputted from the turning operation device 53 increases in accordance with increase in the inclination angle (i.e., operating amount) of the operating lever.

In the present embodiment, the turning operation device 53 is an electrical joystick that outputs an electrical signal as the turning operation signal. The turning operation signal outputted from the turning operation device 53 is inputted to the controller 55.

The controller 55 controls the turning supply valve 47 via an unshown pair of solenoid proportional valves, such that the opening area of the turning supply valve 47 is adjusted to an opening area corresponding to the turning operation signal. Alternatively, the turning operation device 53 may be a pilot operation valve that outputs a pilot pressure as the turning operation signal. In this case, the pilot ports of the turning supply valve 47 are connected, by pilot lines, to the turning operation device 53, which is a pilot operation valve. In the case where the turning operation device 53 is a pilot operation valve, the pilot pressure outputted from the turning operation device 53 is detected by a pressure sensor, and inputted to the controller 55.

The left turning supply line 48 and the right turning supply line 49 are connected to each other by a bridging passage 81. The bridging passage 81 is provided with a pair of relief valves 82, which are directed opposite to each other. A portion of the bridging passage 81 between the relief valves 82 is connected to the tank by a make-up line 85 via a check valve 86, whose cracking pressure is set to be slightly high. Also, in the present embodiment, the boom control valve 44 and the unloading valves 26 and 36 are connected to the tank via the check valve 86.

Each of the left turning supply line 48 and the right turning supply line 49 is connected to the make-up line 85 by a corresponding one of bypass lines 83. Alternatively, the pair of bypass lines 83 may be provided on the bridging passage 81 in a manner to bypass the pair of relief valves 82, respectively. The bypass lines 83 are provided with check valves 84, respectively.

The first turning discharge valve 93 is connected to the right turning supply line 49 by a left turning discharge line 92, and connected to the left turning supply line 48 by a right turning discharge line 91. The first turning discharge valve 93 is connected to the tank by a tank line 94.

When a turning acceleration operation is performed (i.e., when the turning operation signal increases) and when a turning constant speed operation is performed (i.e., when the turning operation signal is constant and is not zero), the first turning discharge valve 93 is switched from a neutral position, in which the first turning discharge valve 93 blocks all the lines 91, 92, and 94, to a left turning movement position (left-side position in FIG. 4) or a right turning movement position (right-side position in FIG. 4). On the other hand, when neither the turning acceleration operation nor the turning constant speed operation is performed, the first turning discharge valve 93 is kept in the neutral position.

When the first turning discharge valve 93 is in the left turning movement position, the first turning discharge valve 93 brings the left turning discharge line 92 into communication with the tank line 94, and blocks the right turning discharge line 91. On the other hand, when the first turning discharge valve 93 is in the right turning movement position, the first turning discharge valve 93 brings the right turning discharge line 91 into communication with the tank line 94, and blocks the left turning discharge line 92. That is, when the turning acceleration operation is performed and when the turning constant speed operation is performed, the first turning discharge valve 93 allows the hydraulic oil to flow from the left turning supply line 48 or the right turning supply line 49 to the tank. When neither the turning acceleration operation nor the turning constant speed operation is performed (e.g., when a turning deceleration operation, which will be described below, is performed), the first turning discharge valve 93 prohibits the hydraulic oil from flowing from the left turning supply line 48 and the right turning supply line 49 to the tank.

In the present embodiment, the first turning discharge valve 93 is a hydraulic pilot-type valve, and includes a pair of pilot ports. Alternatively, the first turning discharge valve 93 may be a solenoid pilot-type valve. The controller 55 controls the first turning discharge valve 93 via an unshown pair of solenoid proportional valves. To be more specific, when the turning acceleration operation is performed and when the turning constant speed operation is performed, the controller 55 controls the first turning discharge valve 93, such that the opening area of the first turning discharge valve 93 is adjusted to an opening area corresponding to the turning operation signal.

The second turning discharge valve 97 is connected to the right turning supply line 49 by a left turning discharge line 96, and connected to the left turning supply line 48 by a right turning discharge line 95. The second turning discharge valve 97 is connected also to the regenerative motor 76 by a regenerative line 98, and the regenerative motor 76 is connected to the tank by a tank line 99.

When a turning deceleration operation is performed (i.e., when the turning operation signal decreases), the second turning discharge valve 97 is switched from a neutral position, in which the second turning discharge valve 97 blocks all the lines 95, 96, and 98, to a left turning movement position (left-side position in FIG. 4) or a right turning movement position (right-side position in FIG. 4). That is, when a turning operation is performed, the first turning discharge valve 93 is used for the first half of the operation, and the second turning discharge valve 97 is used for the second half of the operation. On the other hand, when the turning deceleration operation is not performed, the second turning discharge valve 97 is kept in the neutral position.

When the second turning discharge valve 97 is in the left turning movement position, the second turning discharge valve 97 brings the left turning discharge line 96 into communication with the regenerative line 98, and blocks the right turning discharge line 95. On the other hand, when the second turning discharge valve 97 is in the right turning movement position, the second turning discharge valve 97 brings the right turning discharge line 95 into communication with the regenerative line 98, and blocks the left turning discharge line 96. That is, when the turning deceleration operation is performed, the second turning discharge valve 97 allows the hydraulic oil to flow from the left turning supply line 48 or the right turning supply line 49 to the regenerative motor 76. When the turning deceleration operation is not performed (e.g., when the above-described turning acceleration operation is performed and when the above-described turning constant speed operation is performed), the second turning discharge valve 97 prohibits the hydraulic oil from flowing from the left turning supply line 48 and the right turning supply line 49 to the regenerative motor 76.

In the present embodiment, the second turning discharge valve 97 is a hydraulic pilot-type valve, and includes a pair of pilot ports. Alternatively, the second turning discharge valve 97 may be a solenoid pilot-type valve. The controller 55 controls the second turning discharge valve 97 via an unshown pair of solenoid proportional valves. To be more specific, when the turning deceleration operation is performed, the controller 55 controls the second turning discharge valve 97, such that the opening area of the second turning discharge valve 97 is adjusted to an opening area corresponding to the turning operation signal.

The regenerative motor 76 is a variable displacement motor (swash plate motor or bent axis motor) whose tilting angle is changeable. The tilting angle of the regenerative motor 76 is adjusted by a regulator 79. The regulator 79 moves in accordance with, for example, an electrical signal. For example, in a case where the regenerative motor 76 is a swash plate motor, the regulator 79 may electrically change the hydraulic pressure applied to a servo piston coupled to the swash plate of the motor, or may be an electric actuator coupled to the swash plate of the motor.

The regulator 79 is controlled by the controller 55. The controller 55 controls the regulator 79, such that the volume of the regenerative motor 76 decreases in accordance with decrease in the operating amount (i.e., inclination angle) of the operating lever of the turning operation device 53.

The regenerative motor 76 is coupled to the first pump 21 via a one-way clutch 77. Only when the rotational speed of the regenerative motor 76 is higher than the rotational speed of the first pump 21, the one-way clutch 77 allows the transmission of rotation and torque from the regenerative motor 76 to the first pump 21, and when the rotational speed of the regenerative motor 76 is lower than the rotational speed of the first pump 21, the one-way clutch 77 does not allow the transmission of rotation and torque from the regenerative motor 76 to the first pump 21.

Also in the present embodiment, the controller 55 determines whether or not a pressure accumulation condition is satisfied, and determines whether or not a pressure release condition is satisfied. When the pressure accumulation condition is satisfied, the controller 55 switches the accumulator switching valve 73 to the pressure accumulation position. When the pressure release condition is satisfied, the controller 55 switches the accumulator switching valve 73 to the pressure release position. When neither the pressure accumulation condition nor the pressure release condition is satisfied, the controller 55 switches the accumulator switching valve 73 to the neutral position.

In the present embodiment, the pressure accumulation condition is defined to include that a turning deceleration operation is performed alone, and that a turning deceleration operation is performed concurrently with another operation and the delivery pressure of the first pump 21 detected by the pressure sensor 56 at the time is lower than a threshold $\beta 1$.

It should be noted that since operation signals outputted from the boom operation device 52, the unshown arm operation device, the unshown bucket operation device, the unshown left-running operation device, and the unshown right-running operation device are also inputted to the controller 55, the controller 55 can determine whether or not the pressure accumulation condition is satisfied based on all the operation signals inputted to the controller 55.

When the turning deceleration operation is performed alone, the controller 55 fully closes the unloading valve 26, and maximizes the opening area of the accumulator switching valve 73.

When the pressure accumulation condition is satisfied, if the satisfied pressure accumulation condition is that the turning deceleration operation is performed concurrently with another operation and the delivery pressure of the first pump 21 at the time is lower than the threshold $\beta 1$, the controller 55 controls the unloading valve 26, such that the opening area of the unloading valve 26 is adjusted to an opening area corresponding to the operation signal of the other operation. In addition, the controller 55 adjusts the opening area of the accumulator switching valve 73 in accordance with a pressure difference between the delivery pressure of the first pump 21 and the setting pressure of the accumulator 75.

The pressure release condition is that the turning deceleration operation is not performed and the delivery pressure of the first pump 21 detected by the pressure sensor 56 at the time is higher than a reference value $\beta 2$. The reference value $\beta 2$ associated with the pressure release condition is greater than the threshold $\beta 1$ associated with the pressure accumulation condition. However, the pressure release condition is not limited to such a condition, but may be a condition that a particular operation is performed.

As described above, in the hydraulic drive system 1C of the present embodiment, when a turning deceleration operation is performed, high-pressure hydraulic oil discharged from the turning motor 16 is led to the regenerative motor 76. Accordingly, motive power and energy are regenerated from the hydraulic oil discharged from the turning motor 16, and the regenerated motive power and energy assist the driving of the first pump 21 and the second pump 31. Therefore, in a case where the accumulator switching valve 73 is in the neutral position and the turning deceleration operation is performed concurrently with another operation, the regenerated motive power and energy are directly utilized for moving a hydraulic actuator different from the turning motor 16.

On the other hand, when the turning deceleration operation is performed alone, since the accumulator switching valve 73 is switched to the pressure accumulation position, the regenerated motive power and energy can be accumulated in the accumulator 75 as pressure. At the time, since the regenerative motor 76 and the first pump 21 are interposed between the second turning discharge valve 97 and the accumulator 75, the turning speed mainly depends on the tilting angle of the regenerative motor 76 (i.e., motor capacity) and the opening area of the second turning discharge valve 97. This makes it possible to prevent changes in the pressure of the accumulator 75 from affecting the turning speed. Moreover, even during turning deceleration, by applying a load to the first pump 21 and causing the regenerative motor 76 to generate torque, the outlet pressure of the turning motor 16 can be kept high, which makes it possible to impart, to the turning motor 16, necessary braking force for the turning motor 16 to decelerate.

It should be noted that the pressure accumulation condition may only be that a turning deceleration operation is performed alone. However, if the pressure accumulation condition is set as in the present embodiment, not only when the turning deceleration operation is performed alone, but also when the turning deceleration operation is performed concurrently with another particular operation, the regenerated motive power and energy can be accumulated in the accumulator 75.

Further, in the present embodiment, the regenerative motor 76 is coupled to the first pump 21 via the one-way clutch 77. Therefore, when the turning deceleration operation is not performed, the regenerative motor 76 can be prevented from rotating together with the first pump 21, and thereby wasteful motive power consumption can be prevented.

Still further, in the present embodiment, the pressure release condition is that the turning deceleration operation is not performed and the delivery pressure of the first pump 21 at the time is higher than the reference value (32. Therefore, the regenerated motive power and energy accumulated in the accumulator 75 can be utilized when the load on the hydraulic actuator to which the hydraulic oil is supplied from the first pump 21 is relatively great.

Still further, in the present embodiment, when the turning deceleration operation is performed alone, the unloading valve 26 is fully closed. Accordingly, when the turning deceleration operation is performed alone, bleed-off through the unloading line 25 is interrupted, and thereby the regenerated motive power and energy can be accumulated without waste.

Other Embodiments

The present invention is not limited to the above-described embodiments. Various modifications can be made without departing from the spirit of the present invention.

For example, in Embodiment 1, the relay line 66 may be eliminated. In this case, the check valve 37 of the second suction line 33, the relief line 68, and the check valve 63 of the regenerative line 62 can also be eliminated.

In Embodiment 3, similar to Embodiment 2, the second pump 31 may be eliminated, and the first pump 21 may be connected to all the control valves by the first delivery line 24.

Alternatively, in Embodiment 3, the second suction line 33 may be provided with the check valve 37 (see FIG. 1), and the accumulator 75 and the accumulator switching valve 73 may be provided at the second pump 31 side. That is, the accumulator switching valve 73 may be connected to the second delivery line 34 by the pressure accumulation line 71, and may be connected to the portion of the second suction line 33 downstream of the check valve 37 by the pressure release line 72. By adopting such a configuration, when a turning operation is performed alone, the following advantages are obtained: regenerated energy can be accumulated in the accumulator to the utmost degree during turning deceleration; and the delivery pressure of the first pump 21 connected to the turning supply valve 47 can be prevented from becoming unnecessarily high, and thereby wasteful motive power consumption can be avoided.

In Embodiment 3, when a turning deceleration operation is performed, the controller 55 may switch the turning supply valve 47 to the neutral position. Also in this case, the hydraulic oil is supplied from the tank to the turning motor 16 through one check valve 84.

Figure 5:
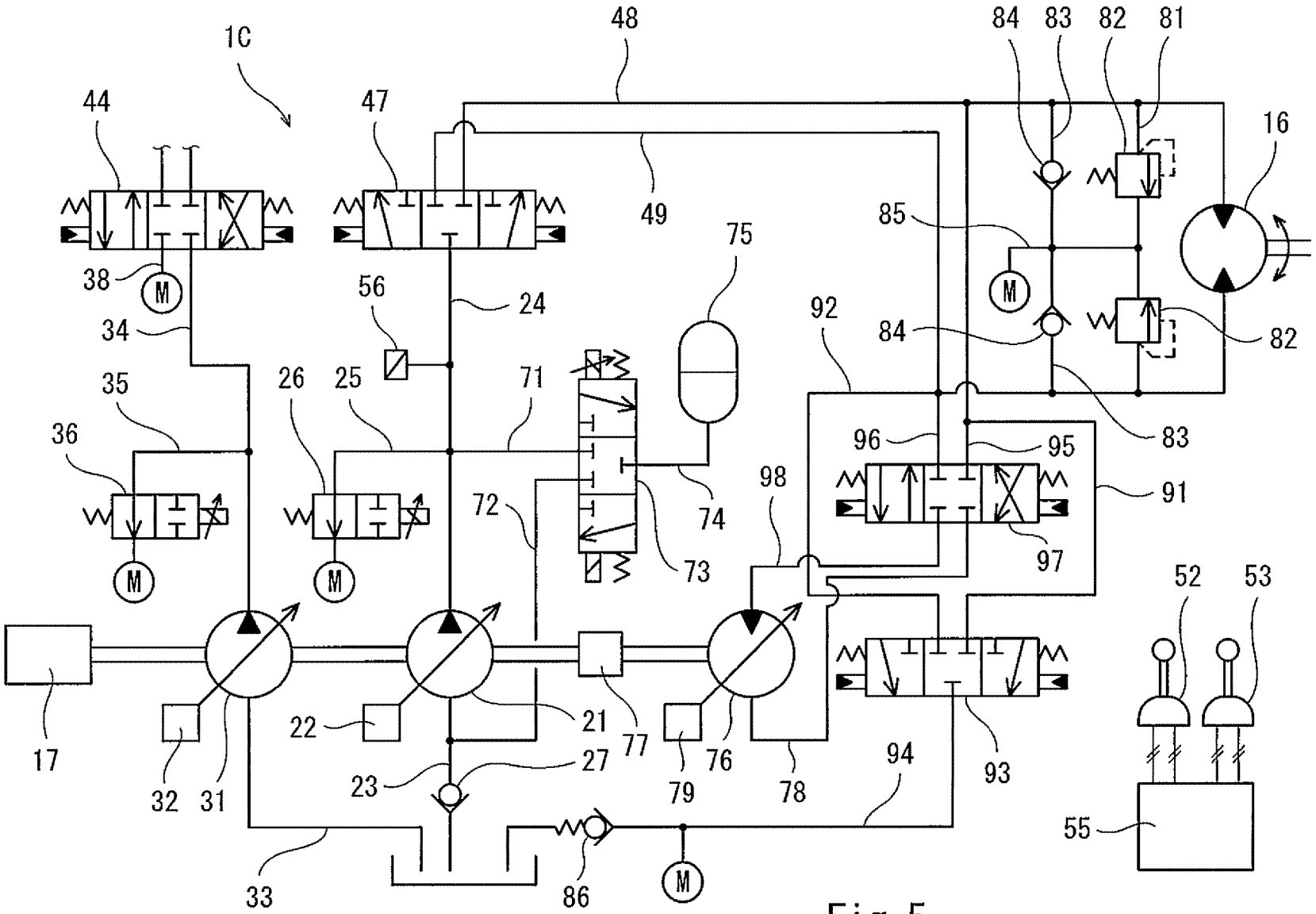
FIG. 5 shows a variation of Embodiment 3.

Alternatively, as shown in FIG. 5, the hydraulic oil discharged from the regenerative motor 76 may be returned to the turning motor 16. To be more specific, the regenerative motor 76 may be connected to the second turning discharge valve 97 by a return line 78, and the second turning discharge valve 97 may be configured such that, when the second turning discharge valve 97 is in the left turning movement position, the second turning discharge valve 97 brings the return line 78 into communication with the right turning discharge line 95, and when the second turning discharge valve 97 is in the right turning movement position, the second turning discharge valve 97 brings the return line 78 into communication with the left turning discharge line 96.

Still further, components in Embodiment 1 for regenerating energy from the hydraulic oil discharged from the boom cylinder 13 (i.e., the regenerative valve 61 and the regenerative line 62), and components in Embodiment 3 for regenerating energy from the hydraulic oil discharged from the turning motor 16 (i.e., the regenerative motor 76, the turning supply valve 47, the first turning discharge valve 93, and the second turning discharge valve 97), may be combined.

REFERENCE SIGNS LIST

1A to 1C hydraulic drive system
13 boom cylinder
14 arm cylinder
16 turning motor
21 first pump
23 first suction line
24 first delivery line

25 unloading line
26 unloading valve
27 check valve
31 second pump
33 second suction line
34 second delivery line
37 check valve
41 arm control valve
42 arm crowding supply line
43 arm pushing supply line
44 boom control valve
45 boom raising supply line
46 boom lowering supply line
47 turning supply valve
48 left turning supply line
49 right turning supply line
55 controller
61 regenerative valve
62 regenerative line
65, 69 relief valve
66 relay line
67 check valve
73 accumulator switching valve
75 accumulator
76 regenerative motor
77 one-way clutch
93 first turning discharge valve
97 second turning discharge valve

The invention claimed is:

1. A hydraulic drive system of a construction machine, the hydraulic drive system comprising:

a boom cylinder;

a boom control valve connected to the boom cylinder by a boom raising supply line and a boom lowering supply line, the boom control valve blocking the boom raising supply line when a boom lowering operation is performed;

a pump that sucks hydraulic oil through a suction line provided with a check valve, and delivers the hydraulic oil through a delivery line;

a regenerative line that connects between the boom raising supply line and a portion of the suction line downstream of the check valve;

a regenerative valve that brings the boom raising supply line and the portion of the suction line downstream of the check valve into communication with each other through the regenerative line when the boom lowering operation is performed, and prohibits the hydraulic oil from flowing through the regenerative line when the boom lowering operation is not performed;

a relief valve that keeps a pressure of the portion of the suction line downstream of the check valve to a predetermined pressure or lower;

an accumulator switching valve that is switched between a pressure accumulation position, in which the accumulator switching valve connects an accumulator to the delivery line, a pressure release position, in which the accumulator switching valve connects the accumulator to the portion of the suction line downstream of the check valve, and a neutral position, in which the accumulator switching valve shuts off the accumulator from the delivery line and the portion of the suction line downstream of the check valve; and a controller that controls the accumulator switching valve, wherein the controller:

switches the accumulator switching valve to the pressure accumulation position when a pressure accumulation condition is satisfied, the pressure accumulation condition being defined to include that the boom lowering operation is performed alone;

switches the accumulator switching valve to the pressure release position when a pressure release condition is satisfied; and switches the accumulator switching valve to the neutral position when neither the pressure accumulation condition nor the pressure release condition is satisfied.

2. The hydraulic drive system of a construction machine according to claim 1, wherein the pressure accumulation condition is defined to include that the boom lowering operation is performed alone, and that the boom lowering operation is performed concurrently with another operation and a delivery pressure of the pump at the time is lower than a threshold.

3. The hydraulic drive system of a construction machine according to claim 1, wherein the pressure release condition is that a delivery pressure of the pump is higher than a reference value.

4. The hydraulic drive system of a construction machine according to claim 1, wherein the pump, the suction line, and the delivery line are a first pump, a first suction line, and a first delivery line, respectively, the hydraulic drive system further comprises:

an arm cylinder;

an arm control valve connected to the arm cylinder by an arm crowding supply line and an arm pushing supply line; and a second pump that sucks the hydraulic oil through a second suction line, and delivers the hydraulic oil through a second delivery line, the first pump is connected to the arm control valve by the first delivery line, and the second pump is connected to the boom control valve by the second delivery line.

5. The hydraulic drive system of a construction machine according to claim 4, wherein the regenerative line is provided with a check valve that allows the hydraulic oil to flow from the boom raising supply line to the first suction line, and prohibits the hydraulic oil from flowing from the first suction line to the boom raising supply line, the second suction line is provided with a check valve, and a portion of the second suction line downstream of the check valve is connected by a relay line to a portion, of the regenerative line, that is closer to the boom raising supply line than the check valve of the regenerative line is, the relay line is provided with a check valve that allows the hydraulic oil to flow from the regenerative line to the second suction line, and prohibits the hydraulic oil from flowing from the second suction line to the regenerative line, and the hydraulic drive system further comprises a relief valve that keeps a pressure of the portion of the second suction line downstream of the check valve to a predetermined pressure or lower.

6. The hydraulic drive system of a construction machine according to claim 4, wherein the first pump is a variable displacement pump whose minimum delivery flow rate is set to be greater than zero, the hydraulic drive system further comprises an unloading valve provided on an unloading line that is branched off from the first delivery line, and the controller fully closes the unloading valve when the boom lowering operation is performed alone.

7. A hydraulic drive system of a construction machine, the hydraulic drive system comprising:

a turning motor;

a turning supply valve connected to the turning motor by a pair of turning supply lines, the turning supply valve blocking one of the turning supply lines when a turning operation is performed;

a pump that sucks hydraulic oil through a suction line provided with a check valve, and delivers the hydraulic oil through a delivery line;

a regenerative motor coupled to the pump;

a first turning discharge valve that allows the hydraulic oil to flow from one of the turning supply lines to a tank when a turning acceleration operation is performed and when a turning constant speed operation is performed, and prohibits the hydraulic oil from flowing from both of the turning supply lines to the tank when neither the turning acceleration operation nor the turning constant speed operation is performed;

a second turning discharge valve that allows the hydraulic oil to flow from one of the turning supply lines to the regenerative motor when a turning deceleration operation is performed, and prohibits the hydraulic oil from flowing from both of the turning supply lines to the regenerative motor when the turning deceleration operation is not performed;

an accumulator switching valve that is switched between a pressure accumulation position, in which the accumulator switching valve connects an accumulator to the delivery line, a pressure release position, in which the accumulator switching valve connects the accumulator to a portion of the suction line downstream of the check valve, and a neutral position, in which the accumulator switching valve shuts off the accumulator from the delivery line and the portion of the suction line downstream of the check valve; and a controller that controls the accumulator switching valve, wherein the controller:

switches the accumulator switching valve to the pressure accumulation position when a pressure accumulation condition is satisfied, the pressure accumulation condition being defined to include that the turning deceleration operation is performed alone;

switches the accumulator switching valve to the pressure release position when a pressure release condition is satisfied; and switches the accumulator switching valve to the neutral position when neither the pressure accumulation condition nor the pressure release condition is satisfied.

8. The hydraulic drive system of a construction machine according to claim 7, wherein the regenerative motor is coupled to the pump via a one-way clutch that allows transmission of rotation and torque from the regenerative motor to the pump only when a rotational speed of the regenerative motor is higher than a rotational speed of the pump.

9. The hydraulic drive system of a construction machine according to claim 7, wherein the pump is connected to the turning supply valve by the delivery line.

10. The hydraulic drive system of a construction machine according to claim 7, wherein the pressure accumulation condition is defined to include that the turning deceleration operation is performed alone, and that the turning deceleration operation is performed concurrently with another operation and a delivery pressure of the pump at the time is lower than a threshold.

11. The hydraulic drive system of a construction machine according to claim 7, wherein the pressure release condition is that the turning deceleration operation is not performed and a delivery pressure of the pump at the time is higher than a reference value.

12. The hydraulic drive system of a construction machine according to claim 7, wherein the pump is a variable displacement pump whose minimum delivery flow rate is set to be greater than zero, the hydraulic drive system further comprises an unloading valve provided on an unloading line that is branched off from the delivery line, and the controller fully closes the unloading valve when the turning deceleration operation is performed alone.

13. The hydraulic drive system of a construction machine according to claim 7, wherein the regenerative motor is a variable displacement motor.

* * * * *